US009424850B2

(12) United States Patent
Qi et al.

(10) Patent No.: US 9,424,850 B2
(45) Date of Patent: Aug. 23, 2016

(54) METHOD AND APPARATUS FOR ALLOCATING BIT IN AUDIO SIGNAL

(71) Applicant: Huawei Technologies Co., Ltd., Shenzhen (CN)

(72) Inventors: Fengyan Qi, Beijing (CN); Lei Miao, Beijing (CN); Zexin Liu, Beijing (CN)

(73) Assignee: Huawei Technologies Co., Ltd., Shenzhen, Guangdong ( * ) Notice: Subject to any disclaimer, the term of this patent is extended or adjusted under 35 U.S.C. 154(b) by 0 days.

(21) Appl. No.: 14/595,672

(22) Filed: Jan. 13, 2015

(65) Prior Publication Data

US 2015/0162011 A1 Jun. 11, 2015

Related U.S. Application Data

(63) Continuation of application No. PCT/CN2013/076393, filed on May 29, 2013.

(30) Foreign Application Priority Data

Jul. 13, 2012 (CN) ..... 2012 1 0243316

(51) Int. Cl.
*G10L 19/002* (2013.01)
*G10L 19/02* (2013.01)

(52) U.S. Cl.
CPC ..... *G10L 19/002* (2013.01); *G10L 19/0204* (2013.01)

(58) Field of Classification Search
CPC ..... G10L 19/002; G10L 19/0204
See application file for complete search history.

(56) References Cited

U.S. PATENT DOCUMENTS 4,790,015 A * 12/1988 Callens ..... H04B 1/667 375/240
4,949,383 A * 8/1990 Koh ..... H04B 1/667 704/224

(Continued)

FOREIGN PATENT DOCUMENTS

CN 1910656 A 2/2007
CN 101101755 A 1/2008

(Continued)

OTHER PUBLICATIONS

Foreign Communication From a Counterpart Application, European Application No. 13816528.7 Extended European Search Report dated Jul. 14, 2015, 7 pages.

(Continued)

*Primary Examiner* — Brian Albertalli
(74) *Attorney, Agent, or Firm* — Conley Rose, P.C.; Grant Rodolph

(57) ABSTRACT

A method and an apparatus for allocating bits in an audio signal. The method includes dividing a frequency band of an audio signal into a plurality of subbands, quantizing a subband normalization factor of each subband; and an energy attribute of an audio signal of the corresponding group; allocating coding bits to at least one group, where a sum of coding bits allocated to the at least one group is the number of coding bits of the audio signal; and allocating the coding bits allocated to the at least one group to each subband in each group of the at least one group. In a case of a low or medium bit rate, the embodiments of the present invention can, by means of grouping, ensure relatively stable allocation of previous and subsequent frames and reduce impact of global allocation on partial discontinuity.

28 Claims, 2 Drawing Sheets

(56) References Cited

U.S. PATENT DOCUMENTS

| | | | | |
|---|---|---|---|---|
| 5,752,225 | A * | 5/1998 | Fielder | G10L 19/0212 704/203 |
| 5,758,315 | A * | 5/1998 | Mori | G10L 19/002 704/229 |
| 5,825,310 | A * | 10/1998 | Tsutsui | G10L 19/0208 341/51 |
| 6,393,393 | B1 * | 5/2002 | Kawahara | H04B 1/667 704/219 |
| 6,456,968 | B1 * | 9/2002 | Taniguchi | G06T 9/007 704/229 |
| 6,625,574 | B1 * | 9/2003 | Taniguchi | G10L 19/0208 375/240.03 |
| 6,693,963 | B1 * | 2/2004 | Taniguchi | G10L 19/0208 375/240.11 |
| 2003/0112979 | A1 * | 6/2003 | Toyama | G10L 19/0208 381/23 |
| 2006/0069555 | A1 * | 3/2006 | Konda | G10L 19/035 704/229 |
| 2007/0078651 | A1 * | 4/2007 | Kim | G10L 19/0204 704/229 |
| 2008/0133246 | A1 | 6/2008 | Fellers et al. | |
| 2009/0313029 | A1 | 12/2009 | Luo et al. | |
| 2011/0096830 | A1 | 4/2011 | Ashley et al. | |
| 2012/0290305 | A1 | 11/2012 | Feng et al. | |
| 2013/0018660 | A1 | 1/2013 | Qi et al. | |
| 2013/0339012 | A1 * | 12/2013 | Kawashima | G10L 19/0208 704/219 |

FOREIGN PATENT DOCUMENTS

| | | | |
|---|---|---|---|
| CN | 101499279 | A | 8/2009 |
| CN | 102208188 | A | 10/2011 |
| CN | 102332267 | A | 1/2012 |
| EP | 1852849 | A1 | 11/2007 |
| EP | 2402939 | A1 | 1/2012 |
| JP | 2000078018 | A | 3/2000 |
| JP | 20010044844 | A | 2/2001 |
| JP | 2002091498 | A | 3/2002 |
| JP | 2011501246 | A | 1/2011 |
| WO | 2009056866 | A1 | 5/2009 |

OTHER PUBLICATIONS

Foreign Communication From a Counterpart Application, PCT Application No. PCT/CN2013/076393, English Translation of International Search Report dated Sep. 5, 2013, 3 pages.

Foreign Communication From a Counterpart Application, PCT Application No. PCT/CN2013/076393, English Translation of Written Opinion dated Sep. 5, 2013, 7 pages.

Foreign Communication From a Counterpart Application, Chinese Application No. 201210243316.4, Chinese Search Report dated Jul. 24, 2015, 2 pages.

Foreign Communication From a Counterpart Application, Chinese Application No. 201210243316.4, Chinese Office Action dated Aug. 4, 2015, 4 pages.

Foreign Communication From a Counterpart Application, Korean Application No. 10-2015-7003447, Korean Office Action dated Nov. 13, 2015, 5 pages.

Foreign Communication From a Counterpart Application, Korean Application No. 10-2015-7003447, English Translation of Korean Office Action dated Nov. 27, 2015, 8 pages.

Partial English Translation and Abstract of Japanese Patent Application No. JPA2000078018, Jun. 20, 2016, 62 pages.

Partial English Translation and Abstract of Japanese Patent Application No. JPA2001044844, Jun. 20, 2016, 102 pages.

Partial English Translation and Abstract of Japanese Patent Application No. JPA2002091498, Jun. 20, 2016, 19 pages.

Foreign Communication From a Counterpart Application, Japanese Application No. 2015-520801, Japanese Office fiction dated May 31, 2016, 3 pages.

Foreign Communication From a Counterpart Application, Japanese Application No. 2015-520801, English Translation of Japanese Office Action dated May 31, 2016, 4 pages.

* cited by examiner

METHOD AND APPARATUS FOR ALLOCATING BIT IN AUDIO SIGNAL

CROSS-REFERENCE TO RELATED APPLICATION

This application is a continuation of International Application No. PCT/CN2013/076393, filed on May 29, 2013, which claims priority to Chinese Patent Application No. 201210243316.4, filed on Jul. 13, 2012, both of which are hereby incorporated by reference in their entireties.

TECHNICAL FIELD

Embodiments of the present invention relate to the field of audio technologies, and in particular, to a method and an apparatus for allocating bits in an audio signal.

BACKGROUND

Audio quality is increasingly emphasized in current communication transmission. Therefore, it is required that music quality should be improved as much as possible during coding and decoding while speech quality is ensured. Because a music signal contains very rich information, a code excited linear prediction (CELP) coding mode for traditional speech cannot be used. A transform coding method is generally used to process a music signal in the frequency domain, so as to increase coding quality of the music signal. However, how to efficiently encode information by effectively using a limited number of coding bits effectively becomes a current main research topic of audio coding.

In a current audio coding technology, Fast Fourier Transform (FFT) or modified discrete cosine transform (MDCT) is generally used to transform a time-domain signal into a frequency-domain signal, and then the frequency-domain signal is encoded. During transform coding, frequency-domain coefficients are allocated to different bands, a normalized energy is calculated for each band, and energies of coefficients in each band are normalized; then, bit allocation is performed; and finally, the intra-band coefficients are quantized according to bits allocated to each band, where bit allocation is an extremely critical step. Bit allocation refers to allocating, in a process of quantizing spectral coefficients, bits that are of an audio signal and used to quantize the spectral coefficients to subbands according to a subband feature of a spectrum, that is, allocating coding resources available for the audio signal to the subbands, where the coding resources are generally represented by bits.

Further, a current bit allocation process includes allocating a band to a spectral signal, for example, increasing bandwidth gradually from a low frequency to a high frequency according to a theory of critical band; allocating a band to a spectrum, calculating a normalized energy norm for each subband, and quantizing the normalized energy to obtain a subband normalization factor wnorm; arranging subbands in descending order of values of subband normalization factors wnorm; and performing bit allocation, for example, allocating the number of bits to each subband in an iterative manner according to the value of the subband normalization factor wnorm. The allocating bits in an iterative manner may be further divided into the following steps: step 1: Initialize the number of bits and an iteration factor fac of each subband; step 2: Find out a band corresponding to a greatest subband normalization factor wnorm; step 3: Add a bandwidth value to the number of bits allocated to the band, and subtract the iteration factor fac from the value of the subband normalization factor wnorm; step 4: Iterate step 2 and step 3 until the bit allocation is completed. It can be learned that, in the prior art, a smallest unit of bits during each allocation is a bandwidth value and a smallest number of bits required during quantization is less than the bandwidth value. As a result, this allocation of an integer number of bits is relatively inefficient in a case of a low bit rate, and bits cannot be allocated to many bands while excessive bits are allocated to another band. Because bits are allocated to all bands in a cyclic and iterative manner, subbands with different bandwidth have a same cyclic and iteration parameter, and therefore an allocation result is very random and quantization is relatively discrete and previous and subsequent frames are discontinuous.

It can be learned that, bit allocation greatly affects performance in the case of a low bit rate. During bit allocation, bits are usually allocated to all bands according to a value of a normalized energy of each subband; and in a case of an insufficient bit rate, this allocation is very random and relatively discrete, and produces a phenomenon of discontinuous quantization in the time domain.

SUMMARY

Embodiments of the present invention provide a method and an apparatus for allocating bits in an audio signal, which can solve a problem, caused by an existing bit allocation method, that in a case of a low or medium bit rate, allocation is random and discrete and quantization is discontinuous in the time domain.

According to one aspect, a method for allocating bits in an audio signal is provided, including dividing a frequency band of an audio signal into a plurality of subbands, and quantizing a subband normalization factor of each subband; grouping the plurality of subbands into a plurality of groups, where one group of the plurality of groups includes one or more subbands, and acquiring a group parameter of each group, where the group parameter is used to represent a signal characteristic and an energy attribute of an audio signal of the corresponding group; allocating coding bits to at least one group according to the group parameter of each group, where a sum of coding bits allocated to the at least one group is the number of coding bits of the audio signal; and allocating the coding bits allocated to the at least one group to each subband in each group of the at least one group according to the subband normalization factor of each subband in each group of the at least one group.

According to another aspect, an apparatus for allocating bits in an audio signal is provided, including a subband quantizing unit configured to divide a frequency band of an audio signal into a plurality of subbands, and quantize a subband normalization factor of each subband; a grouping unit configured to group the plurality of subbands into a plurality of groups, where one group of the plurality of groups includes one or more subbands, and acquire a group parameter of each group, where the group parameter is used to represent a signal characteristic and an energy attribute of an audio signal of the corresponding group; a first allocating unit configured to allocate coding bits to at least one group according to the group parameter of each group, where a sum of coding bits allocated to the at least one group is the number of coding bits of the audio signal; and a second allocating unit configured to allocate the coding bits allocated to the at least one group to each subband in each group of the at least one group according to the subband normalization factor of each subband in each group of the at least one group.

In a case of a low or medium bit rate, the embodiments of the present invention can, by means of grouping, ensure relatively stable allocation of previous and subsequent frames and reduce an impact of partial discontinuity caused by global allocation.

BRIEF DESCRIPTION OF DRAWINGS

To describe the technical solutions in the embodiments of the present invention more clearly, the following briefly introduces the accompanying drawings required for describing the embodiments or the prior art. The accompanying drawings in the following description show merely some embodiments of the present invention, and a person of ordinary skill in the art may still derive other drawings from these accompanying drawings without creative efforts.

DESCRIPTION OF EMBODIMENTS

The following clearly describes the technical solutions in the embodiments of the present invention with reference to the accompanying drawings in the embodiments of the present invention. The described embodiments are a part rather than all of the embodiments of the present invention. All other embodiments obtained by a person of ordinary skill in the art based on the embodiments of the present invention without creative efforts shall fall within the protection scope of the present invention.

Coding and decoding technical solutions are widely applied to various electronic devices, for example, a mobile phone, a wireless apparatus, a personal data assistant (PDA), a handheld or portable computer, a global positioning system (GPS) receiver/navigator, a camera, an audio/video player, a camcorder, a video recorder, and a monitoring device. Usually, this type of electronic device includes an audio coder or an audio decoder, where the audio coder or decoder may be directly implemented by a digital circuit or a chip, for example, a digital signal processor (DSP), or be implemented by a software code driving a processor to execute a process in the software code.

As an example, in an audio coding technical solution, an audio time-domain signal is first converted to a frequency-domain signal, and then coding bits are allocated to the audio frequency-domain signal for encoding; an encoded signal is transmitted to a decoder using a communications system; and the decoder decodes and restores the encoded signal.

In the present invention, bit allocation is performed according to a grouping theory and signal characteristics. Bands are grouped first, and an energy of a group is weighted according to a characteristic of each group; bit allocation is performed for each group according to the weighted energy; and bits are allocated to each band according to signal characteristics inside each group. Because bits are first allocated to a whole group, a phenomenon of discontinuous allocation is avoided, so that coding quality of different signals is improved. In addition, signal characteristics are considered when bits are allocated inside a group, so that a limited number of bits can be allocated to an important audio band that affects perception.

Figure 1:
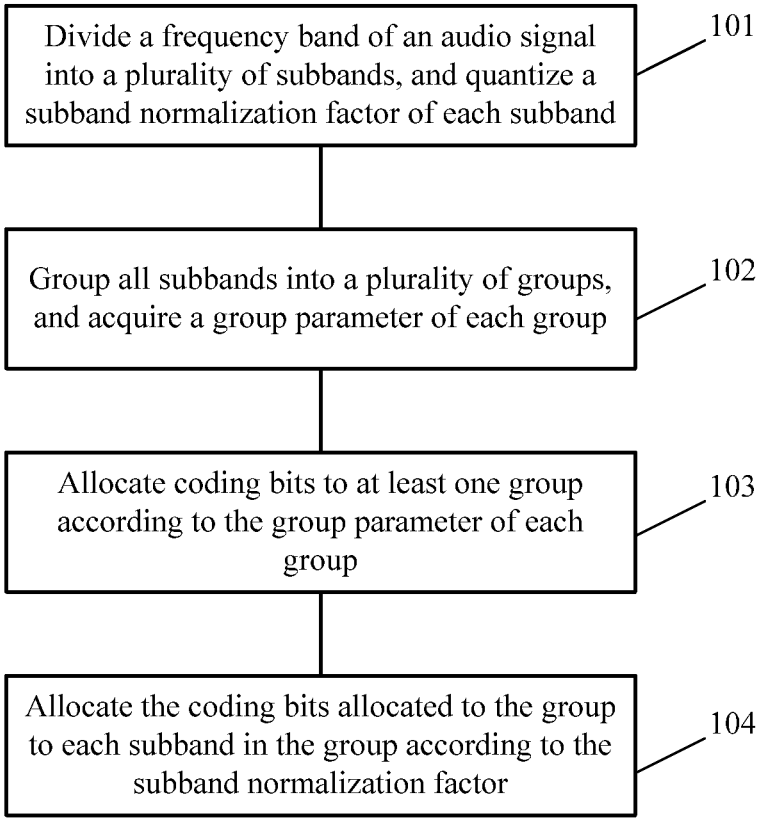
FIG. 1 is a flowchart of a method for allocating bits in an audio signal according to an embodiment of the present invention.

FIG. 1 is a flowchart of a method for allocating bits in an audio signal according to an embodiment of the present invention.

101. Divide a frequency band of an audio signal into a plurality of subbands, and quantize a subband normalization factor of each subband.

MDCT is used as an example in the following description. An MDCT is performed on an input audio signal first to obtain a frequency-domain coefficient. The MDCT here may include processes such as window addition, time-domain aliasing, and discrete cosine transform (DCT).

For example, a sine window is added to an input time-domain signal x(n):

$$h(n) = \sin\left[\left(n + \frac{1}{2}\right)\frac{\pi}{2L}\right], \tag{1}$$

where n=0, . . . , 2L−1 and L represents a frame length of the signal, and an obtained window-added signal is as follows:

$$x_w(n) = \begin{cases} h(n)x_{OLD}(n), & n = 0, \ldots, L-1 \\ h(n)x(n-L), & n = L, \ldots, 2L-1 \end{cases} \tag{2}$$

Then, a time-domain aliasing operation is performed:

$$\tilde{x} = \begin{bmatrix} 0 & 0 & -J_{L/2} & -I_{L/2} \\ I_{L/2} & -J_{L/2} & 0 & 0 \end{bmatrix} x_w \tag{3}$$

$I_{L/2}$ and $J_{L/2}$ represent diagonal matrices with L/2 orders respectively:

$$I_{L/2} = \begin{bmatrix} 1 & & 0 \\ & \ddots & \\ 0 & & 1 \end{bmatrix}, J_{L/2} = \begin{bmatrix} 0 & & 1 \\ & \iddots & \\ 1 & & 0 \end{bmatrix} \tag{4}$$

A discrete DCT transform is performed on a time-domain aliased signal, and finally a frequency-domain MDCT coefficient is obtained:

$$y(k) = \sum_{n=0}^{L-1} \tilde{x}(n)\cos\left[\left(n + \frac{1}{2}\right)\left(k + \frac{1}{2}\right)\frac{\pi}{L}\right], k = 0, \ldots, L-1 \tag{5}$$

Then, a frequency-domain envelope is extracted from the MDCT coefficient and is quantized. The whole band is divided into some subbands with different frequency-domain resolutions, and a normalization factor of each subband is extracted, and the subband normalization factor is quantized.

For example, for an audio signal sampled at 32 kilohertz (kHz), its corresponding frequency band is 16 kHz bandwidth; and if a frame length is 20 milliseconds (ms) (640 sampling points), the band may be divided to the following 44 subbands:

8, 8, 8, 8, 8, 8, 8, 8, 8, 8, 8, 8, 8, 8, 8, 8,
16, 16, 16, 16, 16, 16, 16, 16,
24, 24, 24, 24, 24, 24, 24, 24, 24, 24, 24, 24,
32, 32, 32, 32, 32, 32, 32, 32

The subbands are first grouped into several groups, and then the subbands are further grouped inside each group, and a normalization factor of each subband may be defined as follows:

$$\mathrm{Norm}(p) = \sqrt{\frac{1}{L_p}\sum_{k=s_p}^{e_p} y(k)^2}\ ,\ p = 0, \ldots, P-1 \tag{6}$$

where $L_p$ represents the number of coefficients in a subband, $s_p$ represents a start point of a subband, $e_p$ represents an end point of a subband, and P represents the total number of subbands.

After the normalization factor is obtained, the normalization factor may be quantized in the logarithm domain to obtain a quantized subband normalization factor wnorm.

102. Group all subbands into a plurality of groups, and acquire a group parameter of each group, where the group parameter is used to represent a signal characteristic and an energy attribute of an audio signal of the corresponding group, and one group of the plurality of groups includes one or more subbands.

In addition, subbands with similar features and energies may be grouped into one group. For example, subbands with same bandwidth may be grouped into one group. Preferably, adjacent subbands with same bandwidth are grouped into one group. For example, all subbands may be grouped into four groups. Then, in a case of a low bit rate, only first two groups or first three groups are used, and bit allocation is not performed for the remaining groups.

Alternatively, subbands may be grouped according to a relationship between normalization energies norm of the subbands. That is, subbands with approximate subband normalization factors wnorm are grouped into one group. For example, the following method may be used to determine whether subband normalization factors of subbands are approximate: comparing a subband normalization factor wnorm[i] (i=1, . . . , P−1, where P is the total number of subbands) of a subband with a predetermined threshold K. If wnorm[i] is greater than the predetermined threshold K, the subband number i is recorded, and finally subbands with a subband normalization factor wnorm[i] greater than the predetermined threshold K are grouped into one group, and the remaining subbands are grouped into another group. It should be understood that a plurality of predetermined thresholds may be set according to different requirements, so as to obtain more groups.

Optionally, adjacent subbands with approximate subband normalization factors may also be grouped into one group. For example, the following method may be used to determine whether subband normalization factors of adjacent subbands are approximate: wnorm_diff[i], a difference between subband normalization factors of the adjacent subbands, is calculated first, where wnorm_diff[i]=abs(wnorm[i]−wnorm[i−1]) and i=1, . . . , P−1. P is the total number of subbands. If wnorm_diff[i] is less than a predetermined threshold K', it indicates that the subband normalization factors of the adjacent subbands are approximate, so as to determine adjacent subband numbers that can be grouped into one group.

Once grouping of subbands is complete, a group parameter of each group may be acquired, so as to represent an energy attribute of each group. Generally, the group parameter may include one or more of the following: a sum group_wnorm of intra-group subband normalization factors, and a peak-to-average ratio group_sharp of intra-group subband normalization factors.

Further, group_sharp, which is the sum of intra-group subband normalization factors, is a sum of subband normalization factors of all bands in a group, that is, $$\mathrm{group_wnorm}[i] = \sum_{b=S_i}^{E_i} wnorm[b],$$

where $S_i$ represents a start subband in group i, and $E_i$ represents an end subband in group i.

Alternatively, group_sharp, which is the peak-to-average ratio of the intra-group subband normalization factors, is a ratio of a peak value of intra-group subband normalization factors to an average value of intra-group subband normalization factors. That is, $$\mathrm{group_sharp}[i] = \frac{\mathrm{group_peak}[i]}{\mathrm{group_avg}[i]},$$

where group_peak[i] represents the peak value of intra-group subband normalization factors in group i, and group_avg[i] represents the average value of intra-group subband normalization factors in group i.

Alternatively, group_peak, which is the peak value of intra-group subband normalization factors, is a maximum value of subband normalization factors of all subbands in the group, that is, group_peak[i]=Max(wnorm[$S_i$], . . . , wnorm[$E_i$]), where wnorm[$S_i$] represents a subband normalization factor of the start subband in group i, and wnorm[$E_i$] represents a subband normalization factor of the end subband in group i.

Alternatively, group_avg, which is the average value of intra-group subband normalization factors, is an average value of subband normalization factors of all subbands in the group, that is, $$\mathrm{group_avg}[i] = \frac{\mathrm{group_wnorm}[i]}{E_i - S_i + 1},$$

where group_wnorm[i] represents a sum of intra-group subband normalization factors of group i, $S_i$ represents the start subband in group i, and $E_i$ represents the end subband in group i.

103. Allocate coding bits to at least one group according to the group parameter of each group, where a sum of coding bits allocated to the at least one group is the number of coding bits of the audio signal.

Because the foregoing group parameter represents an energy attribute of each group, bits of the audio signal can be allocated to each group according to the group parameter. In this way, in a case of an insufficient bit rate, a grouping principle is used and the energy attribute of each group is considered, so that bit allocation for the audio signal is more concentrated and inter-frame bit allocation is more continuous. It should be understood that the group parameters are not limited to the ones listed above and may also be another parameter that can represent an energy attribute of a group. In one embodiment, in a case of an insufficient bit rate, bits are allocated only to some groups. For example, for a group in which a sum of intra-group subband normalization factors is zero, no bit is allocated; for another example, when the number of bits is very small, there is also be a group that is not allocated any bit. That is, on a basis that the foregoing group parameters are obtained, coding bits may be allocated to the at least one group according to the sum of intra-group subband normalization factors of each group, where the sum of coding bits allocated to the at least one group is the number of coding bits of the audio signal.

Further, the group parameters may also be adjusted to optimize a result of allocation of bits of the audio signal to each group. For example, different weights are assigned to group parameters for different groups according to different allocation requirements, so that a limited number of bits are allocated to a proper group. Then, the bits are further allocated inside this group, so that the bit allocation is no longer discrete, which facilitates encoding of the audio signal.

The following describes an example of an implementation manner. For example, after the sum group_wnorm of intra-group subband normalization factors of each group and the peak-to-average ratio group_sharp of intra-group subband normalization factors of each group are acquired, the sum group_wnorm of intra-group subband normalization factors may be weighted according to the peak-to-average ratio group_sharp of intra-group subband normalization factors, to obtain a weighted sum group_wnorm_w of intra-group subband normalization factors.

Further, a peak-to-average ratio group_sharp[i] of intra-group subband normalization factors of a first group is compared with a peak-to-average ratio group_sharp[i−1] of intra-group subband normalization factors of a second group. If comparison between the peak-to-average ratio of intra-group subband normalization factors of the first group and the peak-to-average ratio of intra-group subband normalization factors of the second group is greater than a first threshold, the sum of intra-group subband normalization factors of the first group is adjusted according to a first weighting factor, and the sum of intra-group subband normalization factors of the second group is adjusted according to a second weighting factor, and vice versa. That is, if comparison between the peak-to-average ratio of intra-group subband normalization factors of the second group and the peak-to-average ratio of intra-group subband normalization factors of the first group is greater than a second threshold, the sum of intra-group subband normalization factors of the second group is adjusted according to the first weighting factor, and the sum of intra-group subband normalization factors of the first group is adjusted according to the second weighting factor.

For example, if group_sharp[i]−group_sharp[i−1]>a, group_wnorm=b×group_wnorm[i]; or, if group_sharp[i−1]−group_sharp[i]>c, group_wnorm[i−1]=b×group_wnorm[i−1], where group number i=1, . . . , P−1, P is the total number of subbands, b is a weight, a is the first threshold, and c is the second threshold. It should be understood that a, b, and c may be selected according to a bit allocation requirement.

Herein, only a simple weighting method is described exemplarily. A person of ordinary skill in the art should easily use another weighting method to adjust a weight of a subband using different weighting factors. For example, a weight of a subband to which more signal bits need to be allocated may be increased, and a weight of a subband to which a signal bit does not need to be allocated or a few signal bits need to be allocated may be decreased.

Then, bits of the audio signal are allocated to each group according to the weighted sum of intra-group subband normalization factors. For example, the number of bits for the group is determined according to a ratio of the weighted sum group_wnorm[i] of intra-group subband normalization factors to the sum sum_wnorm of subband normalization factors of all subbands, and bits of the audio signal are allocated to the group according to the determined number of bits for the group. The total number group_bits of bits of each group is determined using the following formula: group_bits [i]=sum_bits×group_wnorm[i]/sum_wnorm, where sum_bits represents the total number of bits of the audio signal that need to be allocated, and sum_wnorm represents the sum of subband normalization factors of all subbands.

After the bits are allocated to the groups, coding bits allocated to each group may further be allocated to subbands in the group.

104. Allocate the coding bits allocated to the at least one group to each subband in each group of the at least one group according to the subband normalization factor of each subband in each group of the at least one group.

It should be understood that an existing iterative and cyclic allocation method may be used to allocate bits to subbands in each group. However, the iterative and cyclic allocation method still causes that a bit allocation result in each group is very random and that previous and subsequent frames are discontinuous. Therefore, bits that are of the audio signal and allocated to the group may be allocated to subbands in the group with reference to signal characteristics of different audio signals, that is, different signal types, and according to subband normalization factors in the group.

In addition, in this embodiment of the present invention, in a case of an insufficient bit rate, if a limited number of bits are allocated to all subbands in the group, a bit allocation effect is affected. Therefore, the number band_num of subbands to which bits may be allocated in the group may be determined first; then, the bits that are of the audio signal and allocated to the group are allocated, according to a type of the audio signal and subband normalization factors in the group, to subbands to which bits are allocated in the group, where the number of subbands to which bits are allocated in the group equals the number band_num of subbands.

The number of subbands to which bits are initially allocated in each group may be determined according to the number of bits for the group and a third threshold, where the third threshold represents a smallest number of bits used to quantize a normalized spectral coefficient. For example, if 13 bits are allocated to a group and the third threshold is 7 bits, the number of subbands to which bits are initially allocated in the group is 2. Then, the number band_num of subbands to which bits are allocated in the group is determined according to the number of subbands to which bits are initially allocated in the group and the total number of subbands in the group.

For example, if the number of subbands to which bits are initially allocated in the group is greater than a product of the total number of subbands in the group and a scale factor k, it is determined that the value of band_num is the total number of subbands in the group; if the number of subbands to which bits are initially allocated in the group is greater than the product of the total number of subbands in the group and the scale factor k, the value of band_num is the number of subbands to which bits are initially allocated in the group. The scale factor k here is an empiric factor and may be 0.75 or another numeric value. The process may also be simplified, so that the number band_num of subbands to which bits are allocated in the group is a smaller number of subbands between the number of subbands to which bits are allocated in the group and the total number of subbands in the group.

Then, bits are allocated to band_num subbands according to the type of audio signal in the group and with reference to subband normalization factors in the group, where band_num is the number of subbands to which bits are allocated in the group. The type of the audio signal in the group may be determined according to the peak-to-average ratio group_sharp of the intra-group subband normalization factors of the group. If it is determined, according to the peak-to-average ratio group_sharp of the intra-group subband normalization factors that the audio signal is a normal signal, the existing iterative and cyclic allocation method may be used to perform bit allocation for the group; and if it is determined that the audio signal of the group is a harmonic signal, the existing iterative and cyclic allocation method may be used to perform bit allocation for the group, or the following method a or method b may be used to perform bit allocation.

Method a may comprise the following steps:

Step 1: Arrange subband normalization factors of all subbands in the group in descending order, and select the first N subbands, where N is the number band_num of subbands to which bits are allocated in the group.

Step 2: Initialize the number of bits of the N subbands to 1, and initialize the number j of cycles to 0.

Step 3: Determine the total number band_wnorm of subband normalization factors of subbands with a subband normalization factor greater than 0 in the N subbands.

Step 4: Allocate the numbers of bits to the subbands with a subband normalization factor greater than 0 in the N subbands.

Step 5: Determine whether the number of bits allocated to the last subband of the N subbands is less than a fixed threshold fac; and if the number of bits allocated to the last subband of the N subbands is less than the fixed threshold fac, set the number of bits allocated to the subband to 0.

Step 6: Add 1 to the number j of cycles.

Step 3 to step 6 are repeated until the number j of cycles equals N.

Step 7: Restore an original arrangement sequence of all subbands in the group, that is, restore an arrangement sequence of all subbands before the subband normalization factor of each subband is quantized.

Method b may comprise the following steps:

Step 1: Arrange subband normalization factors of all subbands in the group in descending order, and select the first N subbands, where N is the number band_num of subbands to which bits are allocated in the group.

Step 2: Initialize the number of bits of the N subbands to 1, initialize the number j of cycles to 0, and initialize the number bit_sum of allocated bits to 0.

Step 3: Determine the total number band_wnorm of subband normalization factors of subbands with a subband normalization factor greater than 0 in the N subbands.

Step 4: Allocate numbers of bits to the subbands with a subband normalization factor greater than 0 in the N subbands.

Step 5: Determine whether the number of bits allocated to the N subbands is less than a fixed threshold fac; and if the number of bits allocated to the N subbands is less than the fixed threshold fac, set the number of bits allocated to the N subbands to 0.

Step 6: Calculate the total number temp_sum of bits allocated to all the N subbands.

Step 7: Add 1 to the number j of iterations.

Step 8: Determine whether temp_sum equals bit_sum. If temp_sum equals bit_sum, perform step 10; if the number of subbands to which bits are initially allocated in the group is greater than the product of the total number of subbands in the group and the scale factor k, continue to perform step 9.

Step 9: Update bit_sum and assign a value of temp_sum to bit_sum.

Step 3 to step 9 are repeated until the number j of cycles equals N.

Step 10: Restore an original arrangement sequence of all subbands in the group.

It should be understood that, besides the foregoing method a or method b, another method may also be used to perform bit allocation in the group. In addition, method a and the method b may also be combined with a method for determining band_num, that is, performing allocation in the group with reference to different audio signal characteristics. For example, if the number of subbands to which bits are initially allocated in the group is greater than a product of the total number of subbands in the group and the scale factor k, method a is used; and if the number of subbands to which bits are initially allocated in the group is less than or equal to the product of the total number of subbands in the group and the scale factor k, method b is used.

In conclusion, a process of allocating bits to subbands in a group is as follows: the first N subbands with greatest subband normalization factors are selected from all subbands in the group and used as target subbands for allocation, where N is the number band_num of subbands to which bits are allocated in the group; then, numbers of bits are allocated to the N subbands in sequence according to subband normalization factors of the N subbands; and finally, all subbands in the group are restored to an original arrangement sequence.

According to signal characteristics of different audio signals, bits can be effectively allocated to a band in which a signal can be heard and perceived. For example, for bands with a strong harmonic, bits need to be allocated to all bands with a harmonic wave; and for signals with relatively even spectral energies, bits need to be evenly allocated.

With reference to the foregoing grouping manner, a group may be further segmented, that is, subbands in the group may be further grouped into a plurality of subgroups, and a subgroup parameter of each subgroup is acquired; and then, bits allocated to the group are allocated to each subgroup according to the subgroup parameter of each subgroup. Finally, bits that are of the audio signal and allocated to each subgroup are allocated to each subband in each subgroup according to the subband normalization factor. One possibility is that the subbands are grouped continuously until there is only one band in each group.

Use of the grouping manner in this embodiment of the present invention ensures relatively stable allocation of previous and subsequent frames; and bit allocation with different emphases is performed inside groups according to signal characteristics, so that allocated bits are all used to quantize important spectral information, thereby improving coding quality of an audio signal.

It can be learned from above that the method for allocating bits in an audio signal according to this embodiment of the present invention can, by means of grouping, ensure relatively stable allocation of previous and subsequent frames and reduce impact of partial discontinuity caused by global allocation. In addition, a different threshold parameter may be set for bit allocation in each group, so that bits are allocated more adaptively. Bit allocation with different emphases is performed inside groups according to spectral signal characteristics. For example, for a pseudo harmonic signal with a relatively concentrated spectrum, bits are mainly allocated to a subband with a high energy, and more bits do not need to be allocated to inter-harmonic subbands; and for a signal with a relatively smooth spectrum, smoothness between subbands is ensured as much as possible during bit allocation. This ensures that allocated bits are all used to quantize important spectral information.

Figure 2:
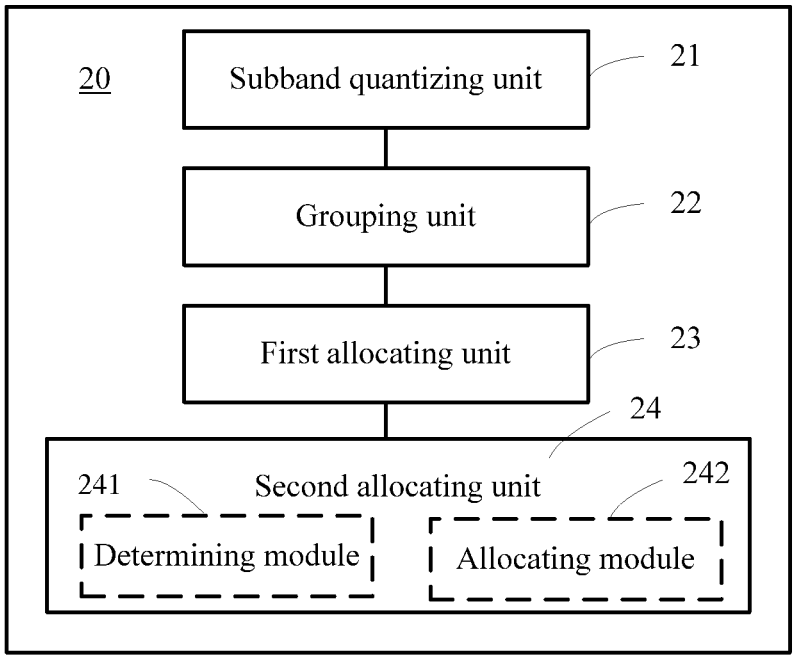
FIG. 2 is a schematic structural diagram of an apparatus for allocating bits in an audio signal according to an embodiment of the present invention.

The following describes, with reference to FIG. 2, a schematic structure of an apparatus 20 for allocating bits in an audio signal according to an embodiment of the present invention.

In FIG. 2, the apparatus 20 for allocating bits in an audio signal includes a subband quantizing unit 21, a grouping unit 22, a first allocating unit 23, and a second allocating unit 24.

The subband quantizing unit 21 is configured to divide a frequency band of an audio signal into a plurality of subbands, and quantize a subband normalization factor of each subband.

The grouping unit 22 is configured to group the plurality of subbands into a plurality of groups, where one group of the plurality of groups includes one or more subbands, and acquire a group parameter of each group, where the group parameter is used to represent a signal characteristic and an energy attribute of an audio signal of the corresponding group.

The first allocating unit 23 is configured to allocate coding bits to at least one group according to the group parameter of each group, where a sum of coding bits allocated to the at least one group is the number of coding bits of the audio signal.

Optionally, the grouping unit 22 may be configured to group subbands with same bandwidth into one group, so that the plurality of subbands is grouped into a plurality of groups. Alternatively, the grouping unit 22 may be configured to group subbands with approximate subband normalization factors into one group, so that the plurality of subbands is grouped into a plurality of groups. Generally, subbands in each group may be adjacent.

Optionally, the grouping unit 22 is configured to acquire a sum of intra-group subband normalization factors of each group and a peak-to-average ratio of intra-group subband normalization factors of each group, where the sum of intra-group subband normalization factors is a sum of subband normalization factors of all subbands in the group, and the peak-to-average ratio of intra-group subband normalization factors is a ratio of a peak value of the intra-group subband normalization factors to an average value of the intra-group subband normalization factors, where the peak value of the intra-group subband normalization factors is a maximum value of subband normalization factors of all subbands in the group, and the average value of the intra-group subband normalization factors is an average value of subband normalization factors of all subbands in the group.

The grouping unit 22 is further configured to weight the sum of intra-group subband normalization factors of each group according to the peak-to-average ratio of intra-group subband normalization factors of each group to obtain a weighted sum of intra-group subband normalization factors of each group.

Optionally, the grouping unit 22 may be configured to compare a peak-to-average ratio of intra-group subband normalization factors of a first group with a peak-to-average ratio of intra-group subband normalization factors of a second group; and if comparison between the peak-to-average ratio of intra-group subband normalization factors of the first group and the peak-to-average ratio of intra-group subband normalization factors of the second group is greater than a first threshold, adjust a sum of intra-group subband normalization factors of the first group according to a first weighting factor, and adjust a sum of intra-group subband normalization factors of the second group according to a second weighting factor.

Optionally, the first allocating unit 23 is configured to allocate coding bits to the at least one group according to a sum of intra-group subband normalization factors of each group, where the sum of coding bits allocated to the at least one group is the number of coding bits of the audio signal. Alternatively, the first allocating unit 23 is configured to allocate coding bits to the at least one group according to the weighted sum of intra-group subband normalization factors, where the sum of coding bits allocated to the at least one group is the number of coding bits of the audio signal. Alternatively, the first allocating unit 23 may be configured to determine the number of bits for the group according to a ratio of the weighted sum of intra-group subband normalization factors of the group to a sum of subband normalization factors of all subbands in the group, and allocate coding bits of the audio signal to the group according to the number of bits for the group.

The second allocating unit 24 is configured to allocate the coding bits allocated to the at least one group to each subband in each group of the at least one group according to the subband normalization factor of each subband in each group of the at least one group.

Further, the second bit allocating module 24 may include a determining module 241 and an allocating module 242. The determining module 241 is configured to determine the number band_num of subbands to which bits are allocated in the group; the allocating module 242 is configured to allocate, according to the subband normalization factors in the group, bits that are of the audio signal and allocated to the group to the subbands to which bits are allocated in the group, where the number of subbands to which bits are allocated in the group equals the number band_num of subbands to which bits are allocated in the group.

Optionally, the determining module 241 may be configured to determine, according to the number of bits for the group and a third threshold, the number of subbands to which bits are initially allocated in the group, where the third threshold represents a smallest number of bits used to quantize a normalized spectral coefficient, and determine that a smaller value between the number of subbands to which bits are initially allocated in the group and the total number of subbands in the group is band_num, the number of subbands to which bits are allocated in the group.

Alternatively, the determining module 241 may be configured to determine the number of subbands to which bits are initially allocated in the group according to the number of bits for the group and a third threshold, where the third threshold represents a smallest number of bits used to quantize a normalized spectral coefficient; compare the number of subbands to which bits are allocated in the group with a product of the total number of subbands in the group and a scale factor k, where the scale factor k is used to adjust the total number of subbands in the group; if the number of subbands to which bits are allocated in the group is less than the product of the total number of subbands in the group and the scale factor k, determine that the number of subbands to which bits are allocated in the group is the number of subbands to which bits are initially allocated; if the number of subbands to which bits are initially allocated in the group is greater than the product of the total number of subbands in the group and the scale factor k, determine that the number of subbands to which bits are allocated in the group is the total number of subbands in the group.

Optionally, the allocating module 242 may be configured to select, from all subbands in the group, the first N subbands with greatest subband normalization factors as target subbands for allocation, where N is the number of subbands to which bits are allocated in the group; allocate numbers of bits to the N subbands in sequence according to subband normalization factors of the N subbands; and restore an original arrangement sequence of all subbands in the group.

For example, the allocating module 242 performs the following steps:

Step 1: Arrange subband normalization factors of all subbands in the group in descending order, and select the first N subbands, where N is the number band_num of subbands to which bits are allocated in the group.

Step 2: Initialize the number of bits of the N subbands to 1, and initialize the number j of cycles to 0.

Step 3: Determine the total number band_wnorm of subband normalization factors of subbands with a subband normalization factor greater than 0 in the N subbands.

Step 4: Allocate numbers of bits to the subbands with a subband normalization factor greater than 0 in the N subbands.

Step 5: Determine whether the number of bits allocated to the last subband of the N subbands is less than a fixed threshold fac; and if the number of bits allocated to the last subband of the N subbands is less than the fixed threshold fac, set the number of bits allocated to the subband to 0.

Step 6: Add 1 to the number j of cycles.

Step 3 to step 6 are repeated until the number j of cycles equals N.

Step 7: Restore an original arrangement sequence of all subbands in the group.

Optionally, the allocating module 242 may be configured to perform the following steps:

Step 1: Arrange subband normalization factors of all subbands in the group in descending order, and select the first N subbands, where N is the number band_num of subbands to which bits are allocated in the group.

Step 2: Initialize the number of bits of the N subbands to 1, initialize the number j of cycles to 0, and initialize the number bit_sum of allocated bits to 0.

Step 3: Determine the total number band_wnorm of subband normalization factors of subbands with a subband normalization factor greater than 0 in the N subbands.

Step 4: Allocate numbers of bits to the subbands with a subband normalization factor greater than 0 in the N subbands.

Step 5: Determine whether the number of bits allocated to the N subbands is less than a fixed threshold fac; and if the number of bits allocated to the N subbands is less than the fixed threshold fac, set the number of bits allocated to the N subbands to 0.

Step 6: Calculate the total number temp_sum of bits allocated to all the N subbands.

Step 7: Add 1 to the number j of cycles.

Step 8: Determine whether temp_sum equals bit_sum. If temp_sum equals bit_sum, perform step 10; if the number of subbands to which bits are initially allocated in the group is greater than the product of the total number of subbands in the group and the scale factor k, continue to perform step 9.

Step 9: Update bit_sum and assign a value of temp_sum to bit_sum.

Step 3 to step 9 is repeated until the number j of cycles equals N.

Step 10: Restore an original arrangement sequence of all subbands in the group.

In addition, in the apparatus for allocating bits in an audio signal according to this embodiment of the present invention shown in FIG. 2, the first allocating unit 23 may further group subbands in the group into a plurality of subgroups and acquire a subgroup parameter of each subgroup; and then, the first allocating unit 23 allocates bits allocated to the group to each subgroup according to the subgroup parameter of each subgroup. Then, the second allocating unit 24 is configured to allocate bits that are of the audio signal and allocated to each subgroup to each subband in each subgroup according to the subband normalization factor.

It can be learned from above that the apparatus for allocating bits in an audio signal according to this embodiment of the present invention can, by means of grouping, ensure relatively stable allocation of previous and subsequent frames and reduce impact of partial discontinuity caused by global allocation. In addition, a different threshold parameter may be set for bit allocation in each group, so that bits are allocated more adaptively. Bit allocation with different emphases is performed inside groups according to spectral signal characteristics. For example, for a pseudo harmonic signal with a relatively concentrated spectrum, bits are mainly allocated to a subband with a high energy, and more bits do not need to be allocated to inter-harmonic subbands; and for a signal with a relatively smooth spectrum, smoothness between subbands is ensured as much as possible during bit allocation. This ensures that allocated bits are all used to quantize important spectral information.

A person of ordinary skill in the art may be aware that, in combination with the examples described in the embodiments disclosed in this specification, units and algorithm steps may be implemented by electronic hardware or a combination of computer software and electronic hardware. Whether the functions are performed by hardware or software depends on particular applications and design constraint conditions of the technical solutions. A person skilled in the art may use different methods to implement the described functions for each particular application, but it should not be considered that the implementation goes beyond the scope of the present invention.

It may be clearly understood by a person skilled in the art that, for the purpose of convenient and brief description, for a detailed working process of the foregoing system, apparatus, and unit, reference may be made to a corresponding process in the foregoing method embodiments, and details are not described herein again.

In the several embodiments provided in the present application, it should be understood that the disclosed system, apparatus, and method may be implemented in other manners. For example, the described apparatus embodiment is merely exemplary. For example, the unit division is merely logical function division and may be other division in actual implementation. For example, a plurality of units or components may be combined or integrated into another system, or some features may be ignored or not performed. In addition, the displayed or discussed mutual couplings or direct couplings or communication connections may be implemented through some interfaces. The indirect couplings or communication connections between the apparatuses or units may be implemented in electronic, mechanical, or other forms.

The units described as separate parts may or may not be physically separate, and parts displayed as units may or may not be physical units, may be located in one position, or may be distributed on a plurality of network units. A part or all of the units may be selected according to actual needs to achieve the objectives of the solutions of the embodiments.

In addition, functional units in the embodiments of the present invention may be integrated into one processing unit, or each of the units may exist alone physically, or two or more units are integrated into one unit.

When the functions are implemented in a form of a software functional unit and sold or used as an independent product, the functions may be stored in a computer-readable storage medium. Based on such an understanding, the technical solutions of the present invention essentially, or the part contributing to the prior art, or a part of the technical solutions may be implemented in a form of a software product. The software product is stored in a storage medium, and includes several instructions for instructing a computer device, which may be a personal computer, a server, or a network device, to perform all or a part of the steps of the methods described in the embodiments of the present invention. The foregoing storage medium includes any medium that can store program code, such as a universal serial bus (USB) flash drive, a removable hard disk, a read-only memory (ROM), a random access memory (RAM), a magnetic disk, or an optical disc.

Figure 3:
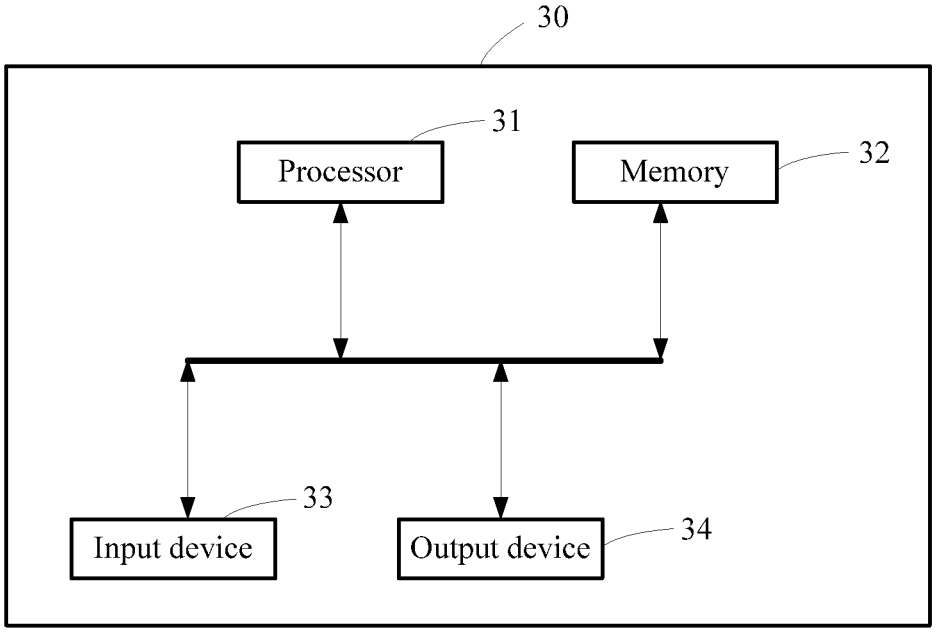
FIG. 3 is a schematic structural diagram of an apparatus for allocating bits in an audio signal according to another embodiment of the present invention.

FIG. 3 is a schematic block diagram of another embodiment of an apparatus 30 for allocating bits in an audio signal according to the present invention. The apparatus 30 includes a processor 31, a memory 32, an input device 33, an output device 34, which communicate with each other by means of a bus. The processor 31 invokes a program stored in the memory 32, and can perform all steps of the foregoing embodiments of the method for allocating bits in an audio signal.

The processor 31 is configured to execute a program of the embodiments of the present invention stored in the memory 32, and implement two-way communication with another apparatus by means of the bus.

The memory 32 may include a RAM or a ROM, or any fixed storage medium or movable storage medium, and is configured to store a program that can execute the embodiments of the present invention or data to be processed in the embodiments of the present invention.

The memory 32 and the processor 31 may also be integrated into a physical module to which the embodiments of the present invention are applied, where the program that implements the embodiments of the present invention is stored in and run on the physical module.

The input device 33 may include any appropriate device such as a keyboard and a mouse, and is configured to receive an input from a user or an input from another device, and send the received input to the processor 31.

The output device 34 is configured to output a result of allocating bits for an audio signal, which may be a display, a printer, or the like.

The foregoing descriptions are merely specific implementation manners of the present invention, and are not intended to limit the protection scope of the present invention. Any variation or replacement readily figured out by a person skilled in the art within the technical scope disclosed in the present invention shall fall within the protection scope of the present invention. Therefore, the protection scope of the present invention shall be subject to the protection scope of the claims.

What is claimed is:

1. A method for allocating bits in an audio signal comprising:

dividing a frequency band of an audio signal into a plurality of subbands;

quantizing a subband normalization factor of each subband;

grouping the plurality of subbands into a plurality of groups, wherein one group of the plurality of groups comprises one or more subbands;

acquiring a group parameter of each group, wherein the group parameter represents an energy attribute of an audio signal of the corresponding group;

allocating coding bits to at least one group according to the group parameter of each group, wherein a sum of a number of the coding bits allocated to each group of the at least one group corresponds to a number of coding bits of the audio signal, wherein one or more of the coding bits are allocated to a particular one of the at least one group; and allocating the one or more of the coding bits to at least one subband in the particular one group according to the subband normalization factor of each subband in the particular one group.

2. The method according to claim 1, wherein acquiring the group parameter of each group comprises acquiring a sum of intra-group subband normalization factors of each group and a peak-to-average ratio of intra-group subband normalization factors of each group, wherein the sum of intra-group subband normalization factors is a sum of subband normalization factors of all subbands in the group, wherein the peak-to-average ratio of intra-group subband normalization factors is a ratio of a peak value of the intra-group subband normalization factors to an average value of the intra-group subband normalization factors, wherein the peak value of the intra-group subband normalization factors is a maximum value of subband normalization factors of all subbands in the group, and wherein the average value of the intra-group subband normalization factors is an average value of subband normalization factors of all subbands in the group, and wherein the coding bits are allocated according to the sum of intra-group subband normalization factors of each group.

3. The method according to claim 1, wherein acquiring the group parameter of each group comprises:

acquiring a sum of intra-group subband normalization factors of each group and a peak-to-average ratio of intra-group subband normalization factors of each group, wherein the sum of intra-group subband normalization factors is a sum of subband normalization factors of all subbands in the group, wherein the peak-to-average ratio of intra-group subband normalization factors is a ratio of a peak value of the intra-group subband normalization factors to an average value of the intra-group subband normalization factors, wherein the peak value of the intra-group subband normalization factors is a maximum value of subband normalization factors of all subbands in the group, and wherein the average value of the intra-group subband normalization factors is an average value of subband normalization factors of all subbands in the group; and weighting the sum of intra-group subband normalization factors of each group according to the peak-to-average ratio of intra-group subband normalization factors of each group to obtain a weighted sum of intra-group subband normalization factors of each group, wherein allocating the coding bits to the at least one group according to the group parameter of each group, and wherein the coding bits are allocated according to the weighted sum of intra-group subband normalization factors of each group.

4. The method according to claim 3, wherein weighting the sum of the intra-group subband normalization factors of each group according to the peak-to-average ratio of the intra-group subband normalization factors of each group comprises:

comparing a peak-to-average ratio of intra-group subband normalization factors of a first group with a peak-to-average ratio of intra-group subband normalization factors of a second group;

adjusting the sum of intra-group subband normalization factors of the first group according to a first weighting factor when comparison between the peak-to-average ratio of intra-group subband normalization factors of the first group and the peak-to-average ratio of intra-group subband normalization factors of the second group is greater than a first threshold; and adjusting the sum of intra-group subband normalization factors of the second group according to a second weighting factor.

5. The method according to claim 3, wherein allocating the coding bits to the at least one group comprises:

determining the number of bits for the particular one group according to a ratio of the weighted sum of intra-group subband normalization factors of the particular one group to a sum of subband normalization factors of all subbands in the groups; and allocating bits of the audio signal to the particular one group according to the number of bits for the particular one group.

6. The method according to claim 1, wherein allocating the one or more of the coding bits comprises:

determining a number of subbands to which bits are to be allocated in the particular one group; and allocating, according to subband normalization factors in the particular one group, coding bits that are allocated to the particular one group to the determined subbands to which bits are to be allocated, and wherein the number of subbands to which bits are to be allocated in the particular one group equals a number of subbands to which the one or more of the coding bits are allocated in the particular one group.

7. The method according to claim 6, wherein determining the number of subbands to which bits are to be allocated in the particular one group comprises determining number of subbands to which bits are initially allocated in the particular one group according to a number of bits for the particular one group and a third threshold, wherein the third threshold represents a smallest number of bits used to quantize a normalized spectral coefficient and, and wherein the number of subbands to which bits are be allocated in the particular one group depends on the number of subbands to which bits are initially allocated in the particular group and a total number of subbands in the particular one group.

8. The method according to claim 7, wherein determining the number of subbands to which bits are to be allocated in the particular one group comprises comparing the number of subbands to which bits are initially allocated in the particular one group and the total number of subbands in the particular one group.

9. The method according to claim 7, wherein determining the number of subbands to which bits are to be allocated in the particular one group comprises comparing the number of subbands to which bits are initially allocated in the particular one group with a product of the total number of subbands in the particular one group and a scale factor k, wherein the scale factor k is used to adjust the total number of subbands in the particular one group, wherein the number of subbands to which bits are to be allocated in the particular one group corresponds to the number of subbands to which bits are initially allocated in the particular one group when the number of subbands to which bits are initially allocated in the particular one group is less than the product of the total number of subbands in the particular one group and the scale factor k, and wherein the number of subbands to which bits are to be allocated in the particular one group corresponds to the total number of subbands in the particular one group when the number of subbands to which bits are initially allocated in the particular one group is greater than the product of the total number of subbands in the particular one group and the scale factor k.

10. The method according to claim 6, wherein allocating, according to the subband normalization factors in the particular one group, the coding bits that are allocated to the particular one group to the determined subbands to which bits are to be allocated in the particular one group comprises:

selecting, from subbands in the particular one group, the first N subbands with greatest subband normalization factors as target subbands for allocation, wherein N is number of subbands to which bits are allocated in the particular one group; and allocating numbers of bits to the N subbands in sequence according to subband normalization factors of the N subbands.

11. The method according to claim 1, wherein allocating the coding bits to the at least one group comprises:

dividing subbands in the particular one group into a plurality of subgroups;

acquiring a subgroup parameter of each subgroup; and allocating bits allocated to the particular one group to each subgroup according to the subgroup parameter of each subgroup, and wherein performing the allocation comprises allocating bits that are of the audio signal and allocated to each subgroup to each subband in each subgroup according to the subband normalization factor.

12. The method according to claim 1, wherein subbands with same bandwidth are grouped into one group.

13. The method according to claim 12, wherein subbands in each group of the plurality of groups are adjacent along a frequency domain.

14. A method for allocating bits in an audio signal comprising:

dividing spectral coefficients of an audio signal into a plurality of subbands;

quantizing a subband normalization factor of each subband to obtain a quantized subband normalization factor of each subband;

grouping the plurality of subbands into a plurality of groups;

acquiring a group parameter of each group, wherein the group parameter represents an energy attribute of an audio signal of the corresponding group;

allocating coding bits to at least one group according to the group parameter of each group, wherein one or more of the coding bits are allocated to a particular one of the at least one group; and allocating the one or more of the coding bits to at least one subband in the particular one group according to the quantized subband normalization factor of each subband in the particular one group.

15. The method according to claim 14, wherein the subband normalization factor of each subband is an envelope of each subband.

16. The method according to claim 14, wherein the plurality of subbands are grouped into three groups.

17. An apparatus for allocating bits in an audio signal comprising:

a processor configured to:

divide a frequency band of an audio signal into a plurality of subbands;

quantize a subband normalization factor of each subband;

group the plurality of subbands into a plurality of groups, wherein one group of the plurality of groups comprises one or more subbands;

acquire a group parameter of each group, wherein the group parameter represents an energy attribute of an audio signal of the corresponding group;

allocate coding bits to at least one group according to the group parameter of each group, wherein a sum of a number of the coding bits allocated to each group of the at least one group corresponds to a number of coding bits of the audio signal, wherein one or more of the coding bits are allocated to a particular one of the at least one group; and allocate the one or more of the coding bits to at least one subband in the particular one group according to the subband normalization factor of each subband in the particular one group.

18. The apparatus according to claim 17, wherein the processor is further configured to acquire a sum of intra-group subband normalization factors of each group and a peak-to-average ratio of intra-group subband normalization factors of each group, wherein the sum of intra-group subband normalization factors is a sum of subband normalization factors of all subbands in the group, wherein the peak-to-average ratio of intra-group subband normalization factors is a ratio of a peak value of the intra-group subband normalization factors to an average value of the intra-group subband normalization factors, wherein the peak value of the intra-group subband normalization factors is a maximum value of subband normalization factors of all subbands in the group, and wherein the average value of the intra-group subband normalization factors is an average value of subband normalization factors of all subbands in the group, and wherein the processor is further configured to allocate the coding bits to the at least one group according to the sum of intra-group subband normalization factors of each group.

19. The apparatus according to claim 17, wherein the processor is further configured to:

acquire a sum of intra-group subband normalization factors of each group and a peak-to-average ratio of intra-group subband normalization factors of each group, wherein the sum of intra-group subband normalization factors is a sum of subband normalization factors of all subbands in the group, wherein the peak-to-average ratio of intra-group subband normalization factors is a ratio of a peak value of the intra-group subband normalization factors to an average value of the intra-group subband normalization factors, wherein the peak value of the intra-group subband normalization factors is a maximum value of subband normalization factors of all subbands in the group, and wherein the average value of the intra-group subband normalization factors is an average value of subband normalization factors of all subbands in the group; and weight the sum of intra-group subband normalization factors of each group according to the peak-to-average ratio of intra-group subband normalization factors of each group to obtain a weighted sum of intra-group subband normalization factors of each group, and wherein the processor is further configured to allocate coding bits to the at least one group according to the weighted sum of intra-group subband normalization factors of each group.

20. The apparatus according to claim 19, wherein the processor is further configured to:

compare a peak-to-average ratio of intra-group subband normalization factors of a first group with a peak-to-average ratio of intra-group subband normalization factors of a second group;

adjust the sum of intra-group subband normalization factors of the first group according to a first weighting factor when comparison between the peak-to-average ratio of intra-group subband normalization factors of the first group and the peak-to-average ratio of intra-group subband normalization factors of the second group is greater than a first threshold; and adjust the sum of intra-group subband normalization factors of the second group according to a second weighting factor.

21. The apparatus according to claim 20, wherein the processor is further configured to:

determine the number of bits for the particular one group according to a ratio of the weighted sum of intra-group subband normalization factors of the particular one group to a sum of subband normalization factors of all subbands in the plurality of groups; and allocate bits of the audio signal to the particular one group according to the number of bits for the particular one group.

22. The apparatus according to claim 17, wherein the processor is further configured to:

determine a number of subbands to which bits are to be allocated in the particular one group; and allocate, according to subband normalization factors in the particular one group, coding bits that are allocated to the particular one group to the determined subbands to which bits are to be allocated in the particular one group, wherein the number of subbands to which bits are to be allocated in the particular one group equals number of subbands to which bits are allocated in the particular one group.

23. The apparatus according to claim 22, wherein the processor is further configured to determine a number of subbands to which bits are initially allocated in the particular one group according to number of bits for the particular one group and a third threshold, wherein the third threshold represents a smallest number of bits used to quantize a normalized spectral coefficient, and wherein the number of subbands to which bits are allocated in the particular one group is determined based on a comparison of the number of subbands to which bits are initially allocated in the particular one group and a total number of subbands in the particular one group.

24. The apparatus according to claim 22, wherein the processor is further configured to:

determine the number of subbands to which bits are initially allocated in the particular one group according to the number of bits for the particular one group and a third threshold, wherein the third threshold represents a smallest number of bits used to quantize a normalized spectral coefficient; and compare the number of subbands to which bits are initially allocated in the particular one group with a product of the total number of subbands in the particular one group and a scale factor k, wherein the scale factor k is used to adjust the total number of subbands in the particular one group, wherein the number of subbands to which bits are to be allocated in the particular one group corresponds to the number of subbands to which bits are initially allocated in the particular one group when the number of subbands to which bits are initially allocated in the particular one group is less than the product of the total number of subbands in the particular one group and the scale factor k, and wherein the number of subbands to which bits are to be allocated in the particular one group corresponds to the total number of subbands in the particular one group when the number of subbands to which bits are initially allocated in the particular one group is greater than the product of the total number of subbands in the particular one group and the scale factor k.

25. The apparatus according to claim 22, wherein the allocating processor is further configured to:

select, from subbands in the particular one group, the first N subbands with greatest subband normalization factors as target subbands for allocation, wherein N is a number of subbands to which bits are allocated in the particular one group; and allocate numbers of bits to the N subbands in sequence according to subband normalization factors of the N subbands.

26. The apparatus according to claim 17, wherein the processor is further configured to:

group subbands in the particular one group into a plurality of subgroups, and acquire a subgroup parameter of each subgroup; and allocate the one or more of the coding bits to each subgroup of the particular one group according to the subgroup parameter of each subgroup, and wherein the processor is further configured to allocate bits that are of the audio signal and allocated to each subgroup to each subband in each subgroup according to the subband normalization factor.

27. The apparatus according to claim 17, wherein the processor is further configured to group subbands with approximate subband normalization factors based on a threshold value into one group.

28. The apparatus according to claim 27, wherein subbands in each group of the plurality of groups are adjacent along a frequency domain.

* * * * *